US005255950A

United States Patent [19]

Davies

[11] Patent Number: 5,255,950

[45] Date of Patent: Oct. 26, 1993

[54] CLAMP WITH FREELY ROTATABLE COUPLING AND ASSOCIATED METHOD OF ROTATABLY MANIPULATING A STRUCTURAL MEMBER

[75] Inventor: William Davies, Ponte Vedra Beach, Fla.

[73] Assignee: J.C. Renfroe and Sons, Inc., Jacksonville, Fla.

[21] Appl. No.: 789,496

[22] Filed: Nov. 8, 1991

[51] Int. Cl.[5] ..... B66C 1/48

[52] U.S. Cl. ..... 294/103.1; 294/101

[58] Field of Search ..... 294/101, 103.1, 104, 294/901, 86.41, 81.62; 269/246, 249, 271, 75

[56] References Cited

U.S. PATENT DOCUMENTS

| | | | |
|---|---|---|---|
| 381,043 | 4/1988 | Vauclain . | |
| 1,285,237 | 11/1918 | Kopcinski | 294/103.1 X |
| 1,507,960 | 9/1924 | Heinzinger . | |
| 1,516,973 | 11/1924 | Loughran | 294/81.62 |
| 2,032,764 | 3/1936 | Otte . | |
| 2,275,162 | 3/1942 | Sutthoff . | |
| 2,396,790 | 3/1946 | Jensen . | |
| 2,544,596 | 3/1951 | Huden . | |
| 2,625,005 | 1/1953 | Myers . | |
| 2,708,999 | 5/1955 | Rush . | |
| 2,759,234 | 8/1956 | Brawand . | |
| 2,890,905 | 6/1959 | Peters . | |
| 2,925,298 | 2/1960 | Robins et al. . | |
| 3,261,636 | 7/1966 | Pierre . | |
| 3,262,679 | 7/1966 | Eggleton et al. . | |
| 3,342,521 | 9/1967 | Renfroe . | |
| 3,705,708 | 12/1972 | Cunningham et al. . | |
| 4,183,571 | 1/1980 | Renfroe . | |
| 4,294,479 | 10/1981 | Archer . | |
| 4,561,199 | 12/1985 | Lockwood . | |
| 4,850,630 | 7/1989 | Davies . | |
| 4,858,977 | 8/1989 | Mitchell . | |
| 4,962,918 | 10/1990 | Yang | 269/249 X |
| 5,005,890 | 4/1991 | Schwenger | 294/103.1 |

FOREIGN PATENT DOCUMENTS

| | | | |
|---|---|---|---|
| 511259 | 3/1955 | Canada . | |
| 1435976 | 3/1966 | France | 294/103.1 |
| 248949 | 7/1969 | U.S.S.R. . | |
| 994390 | 2/1983 | U.S.S.R. | 294/86.41 |
| 1370047 | 1/1988 | U.S.S.R. | 294/86.41 |

*Primary Examiner*—David M. Mitchell
*Assistant Examiner*—Dean J. Kramer
*Attorney, Agent, or Firm*—Banner, Birch, McKie & Beckett

[57] ABSTRACT

A screw-type clamp for gripping structural members such as steel sheets has a generally U-shaped clamp body with projecting portions forming therebetween a material receiving slot. A screw is threadedly received through a portion of the body and has mounted thereon a material gripping element. A material gripping member is also mounted to the body portion opposing the screw, such that structural members may be securely gripped by the gripping surfaces by advancing the screw. The clamp has a freely rotatable coupling member for connection of a shackle. The coupling member includes a rotatable post protruding from the clamp body and having an axis of rotation extending through the material receiving slot, perpendicular to the screw. A lubrication passage insures free rotatability of the rotatable post during a lifting operation. The coupling member provides a rotational degree of freedom allowing, for example, a pair of clamps attached to opposite edges of a structural member to be used to effect a 360° rotation of the structural member about a horizontal axis. One or both of the gripping elements may be pivotably mounted to effect a camming-in action during a lifting operation to enhance the grip of the clamp on the lifted member. In one embodiment, the gripping elements are mounted for limited universal rotation by respective ball and socket configurations. In another embodiment, one of the gripping elements is mounted for pivotal motion about a fixed pivot axis.

39 Claims, 5 Drawing Sheets

CLAMP WITH FREELY ROTATABLE COUPLING AND ASSOCIATED METHOD OF ROTATABLY MANIPULATING A STRUCTURAL MEMBER

BACKGROUND OF THE INVENTION

This invention relates generally to clamps suitable for gripping structural members such as metal plates, beams, angles and the like in order, for example, to lift such a member and to hold and manipulate it for performing industrial operations thereon, or for assembly into a structure.

The prior art contains numerous types of clamps suitable for the gripping of metal plates and the like. Typically, such clamps incorporate one generally fixed jaw and another movable jaw which may be brought into contact with the structural member to be lifted. Certain prior art clamps, known as screw clamps, have incorporated a threaded shaft for advancing one jaw into engagement with the structural member. Commonly assigned U.S. Pat. Nos. 4,183,571 and 4,850,630 disclose screw-type clamps which provided significant improvements over previously existing clamp designs through the use of particular pivotable jaws (material gripping elements). These clamps provide a superior gripping of a clamped structural member, and at the same time eliminate the need to apply an extreme compressive force to the member via the screw. With these clamps, a portion of at least one of the material gripping surfaces is pivotally urged against the surface of the structural member by virtue of lifting torques developed about a pivot axis of a gripping element upon lifting a structural member secured within the clamp. As a result, the gripping element bites into the structural member to provide a secure grip during lifting.

The clamps as described above utilize various means for attachment to a lifting device. In one arrangement disclosed in above-mentioned U.S. Pat. No. 4,188,571, a lifting shackle is attached to the clamp body for pivotal motion in the general plane of the clamp body about a pin extending in a direction perpendicular to the general plane of the clamp body. In a second disclosed embodiment, the clamp incorporates a shackle additionally having a second pivot axis perpendicular to the first pivot axis. The pivotable shackles of these clamps allow, e.g., a steel plate gripped by the clamp at one edge to be rotated from an initial horizontal position through 180°. Such manipulation is useful for handling plates at rolling and forming machines, for example. The provision in the second embodiment of a second pivot axis perpendicular to the first pivot axis allows the clamp to be side-loaded up to 90°.

The clamp of above-mentioned U.S. Pat. No. 4,850,630 incorporates directly in the clamp body at least one aperture for connection of a separate shackle. This design is intended principally for lifting applications not requiring substantial rotation of the lifted member, although, depending on the shackle arrangement employed, a limited degree of material rotation can be obtained.

The above-described clamps advantageously allow a structural member to be rotatably manipulated, at least to a degree, during lifting. However, when a pair of these clamps are positioned at opposite edge portions of a structural member such as a plate to perform a horizontal lift, the clamps do not allow for significant rotation of the structural member about a substantially horizontal axis in order to, for example, facilitate various operations such as welding to be performed on each of opposite surfaces of the member. Furthermore, these clamps, used alone or in pairs, do not allow a full 360° rotation of a lifted member relative to the lifting shackle about any axis.

Commonly assigned U.S. Pat. No. 3,342,521 discloses a lifting clamp having a shackle pin which is initially slideably and rotatably secured to a shackle block in alignment with a material-receiving slot of the clamp. Upon application of a lifting force to the shackle pin during a lifting operation, the shackle block pivots together with the pin out of alignment with the material-receiving slot so as to create a torque gripping action on the article being lifted by the jaws. The shackle pin is not intended to rotate freely during a lifting operation and has no provision to allow the same. Furthermore, to the extent the pin may be somewhat rotatable during lifting, since the shackle pin is, during lifting, translationally and angularly offset from its original position in alignment with the material-receiving slot, the clamp would not be functional, in conjunction with another like clamp, to allow rotation of a structural member about a substantially horizontal axis during a horizontal lift.

Commonly assigned Canadian Patent No. 511,259, discloses a screw-type clamp wherein a cylindrical portion of the screw has mounted thereon a swivel. The swivel is adapted to be rotatably held on the screw by thrust-bearing surfaces. While rotation of a lifted work piece is possible with this clamp, since the swivel axis is coincident with the screw and substantially offset from the material-receiving slot, torques will be developed on the swivel during lifting which will tend to bind the swivel and the thrust bearing surfaces and thereby inhibit free rotation of the clamp during lifting. Such torques may also have the adverse effect of bending the screw to which the swivel is mounted. Furthermore, due to the location and orientation of the swivel, the clamp would not be usable in conjunction with another like clamp to allow rotation of a structural member such as a plate about a horizontal axis during a horizontal lift.

It is known to provide lifting hooks and tackle with 360° rotatable swivels. Typically in such devices a rotatable swivel is provided directly above a hook or other connecting means and has attached thereto a shackle arrangement whereby a lifted work piece may be rotated through 360° about a vertical axis. U.S. Pat. Nos. 381,043; 2,708,999; 2,625,005 and 2,925,298 are exemplary of such known devices. These devices are not suitable for directly clamping and lifting a structural member, nor for allowing rotation of a lifted member about a substantially horizontal axis.

There thus exists a need for a clamp design which is capable of positively and securely gripping a structural member for various lifting and manipulating operations, which affords a rotational degree of freedom allowing the structural member to be freely rotated through 360° relative to a lifting shackle, and which allows, through the use of a pair of clamps, free rotation of a lifted structural member about a horizontal axis.

SUMMARY OF THE INVENTION

An object of the present invention is to provide a clamp for gripping and lifting structural members such as metal plates, beams, angles and the like, which affords a rotational degree of freedom allowing 360° free rotation of a structural member while it is gripped and lifted by the clamp.

It is a further object of the present invention to provide a clamp which can be used in pairs to effect a rotation of a lifted member about a horizontal axis.

It is another object of the present invention to provide a clamp with the capabilities mentioned above, and which further allows rotation of a lifted structural member in the general plane defined by the clamp body, as well as in a direction perpendicular to the general plane of the clamp body.

It is yet a further object of the present invention to provide a clamp allowing for the manipulations described above and having gripping elements configured so as to ensure that the lifted structural member is securely gripped by the clamp during such manipulations without the requirement of imposing extreme compressive forces on the member when the clamp is attached thereto.

Another object of the present invention is to provide a clamp wherein free rotative movement of the clamp with respect to a shackle attached thereto is ensured notwithstanding the forces and torques imposed on the clamp upon lifting a heavy object.

A still further object of the present invention is to provide a clamp having a relatively simple construction, to thereby reduce manufacturing costs and simplify its use.

Still another object of the present invention is to provide a method of lifting and rotatably manipulating a structural member secured by at least a pair of clamps, the method including rotation of a structural member about a generally horizontal axis.

These and other objects are achieved by the present invention which, in a first aspect, provides a clamp for gripping and lifting materials having a clamp body with spaced, opposed, first and second body portions defining therebetween a material receiving slot. The first and second body portions have attached thereto first and second material gripping surfaces, respectively. Adjusting means are provided for adjusting the distance between the first and second material gripping surfaces such that a structural member positioned within the material receiving slot is gripped between the gripping surfaces when the distance between the gripping surfaces is reduced, to thereby enable the structural member to be lifted by the clamp. Coupling means are attached to the clamp body for coupling the clamp to a lifting device. The coupling means includes (a) a coupling member coupled with the clamp body so as to be rotatable 360° relative to the clamp body, which coupling member has connector means for attachment to a lifting device, and (b) friction reducing means for reducing friction between the coupling member and the clamp body so as to insure free 360° rotatability of the clamp body relative to the coupling member during lifting of a structural member gripped by the clamp.

In a second aspect, the present invention provides a clamp for gripping and lifting materials comprising a clamp body having spaced, opposed, first and second body portions defining therebetween a material receiving slot. The first and second body portions have attached thereto first and second material gripping surfaces, respectively. Adjusting means are provided for adjusting the distance between the first and second material gripping surfaces such that a structural member positioned within the material receiving slot is gripped between the gripping surfaces when the distance between the gripping surfaces is reduced, to thereby enable the structural member to be lifted by the clamp. Coupling means are attached to the clamp body for coupling the clamp to a lifting device. The coupling means comprises (a) a coupling member protruding from the clamp body and being rotatably coupled thereto so as to be rotatable about an axis which extends through the material receiving slot substantially perpendicularly to an advancing direction of the adjusting means, and (b) connecting means for attachment to a lifting device.

In yet a further aspect, the present invention provides a screw-type clamp for gripping and lifting materials comprising a generally U-shaped clamp body having first and second projecting portions defining therebetween a material receiving slot. The clamp further has a screw having a shaft threadedly received through the first body projection for rotation about a first axis extending in a general plane defined by the clamp body, the screw having a first end defining a first material gripping surface and extending into the slot towards the second body projection, the screw being threadedly movable toward and away from the second body projection. A gripping element is provided having an inner end mounted in the second body projection and an outer end defining a second material gripping surface so that threaded movement of the screw toward the gripping element urges a structural member in the slot into a gripping relationship between the frist and second material gripping surfaces to enable the structural member to be lifted by the clamp. The second body projection and the inner end of the gripping element define a ball and socket connection therebetween to permit a universal pivotable rotation of the outer end of the gripping element during lifting of the structural member, whereby a portion of the second gripping element is urged inwardly in a camming manner toward a surface of the structural member, to thereby securely grip the structural member. A coupling member is provided comprising (a) a rotatable post protruding from the clamp body and being rotatably mounted thereto so as to rotate freely through 360° about an axis which extends through the material receiving slot substantially perpendicularly to an advancing direction of the screw, and (b) a shackle arrangement provided at an end portion of the post.

In a still further aspect, the present invention provides a method for lifting and rotatably manipulating a structural member. Initially, a rotation axis of the structural member is determined about which it is desired to rotate the structural member. First and second clamping means are then secured to opposite edge portions of the structural member in substantial alignment with the rotation axis, each clamping means having a material receiving slot and a rotatable coupling member which has an axis of rotation extending through and substantially aligned with the material receiving slot. The structural member is lifted via respective shackle arrangements connected to the coupling member of each clamping means such that the structural member is suspended by the shackle arrangements with the rotation axis of the structural member extending in a generally horizontal direction. Finally, the structural member is rotated about the axes of rotation of the connecting members of the respective clamping means, these axes of rotation substantially coinciding with each other and the rotation axis of the structural member.

These and other objects and features of the present invention will be appreciated and fully understood from the following detailed description of preferred embodiments, taken in connection with the appended drawing figures.

DETAILED DESCRIPTION OF THE PREFERRED EMBODIMENTS

Figure 1:
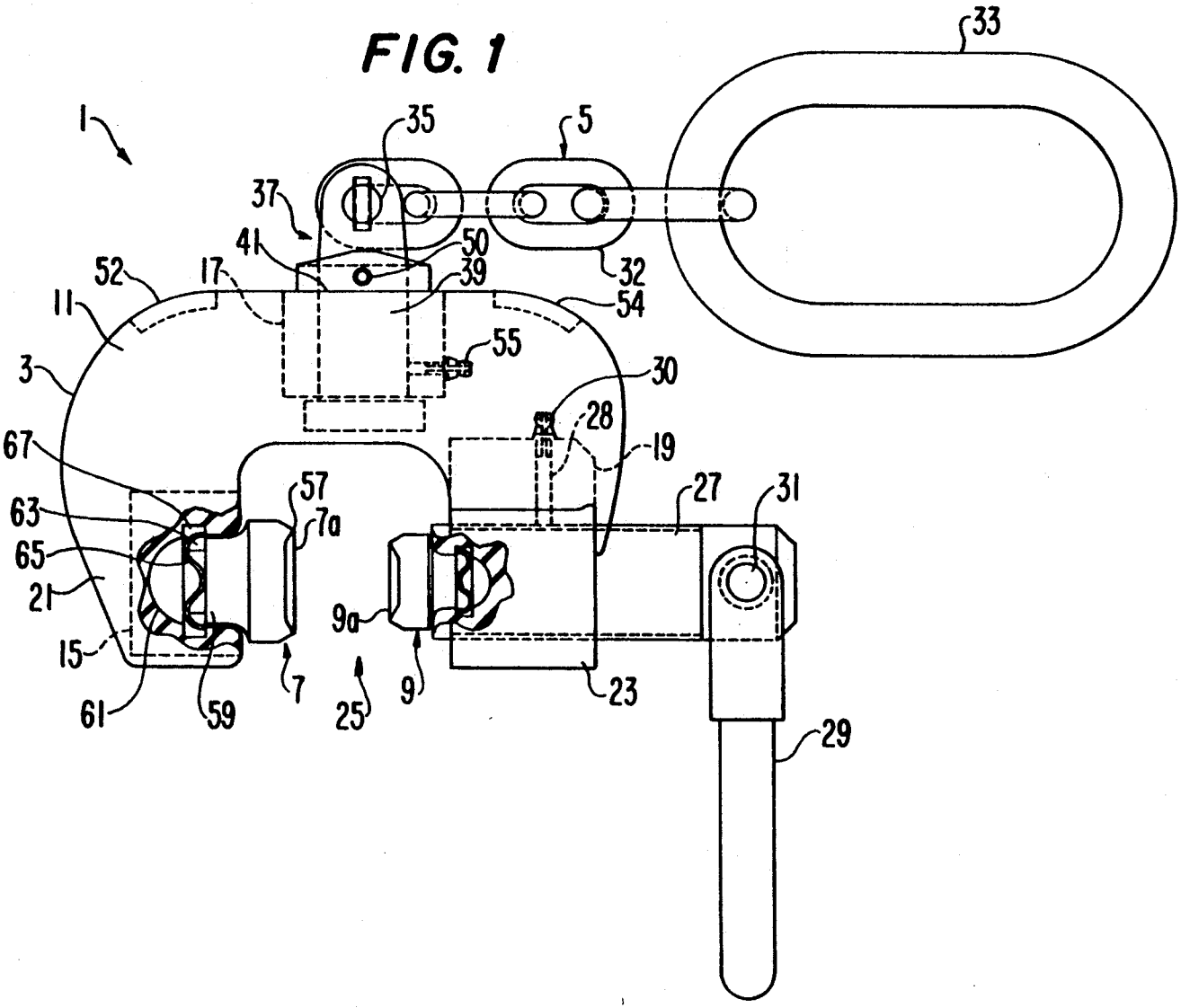
FIG. 1 is a partially broken-away side elevation view of a clamp in accordance with a first embodiment of the present invention.

Referring to FIG. 1, illustrated is a clamp 1 in accordance with a first preferred embodiment of the present invention. The basic components of clamp 1 include a generally U-shaped clamp body 3, a lifting shackle 5, a rotatable coupling 37, material gripping elements 7 and 9, and an adjustment screw 27.

Clamp body 3 conveniently may be fabricated of two substantially identical, generally U-shaped plate members 11, 13 (both seen in FIGS. 2 and 3) weldably secured to each other through blocks 15, 17 and 19. The adjoined U-shaped plate members 11, 13 define a first projecting portion 21 and a second projecting portion 23 which, in turn, define an inwardly extending material receiving slot 25 therebetween.

Gripping element 7 is pivotally secured in projecting portion 21 in a manner to be described in detail hereinafter. Gripping element 9 may be pivotally secured in a like manner at the end of screw element 27 which is threadedly received in block 19 to thereby extend through second projecting portion 23. Screw 27 is utilized to advance and retract gripping element 9 toward and away from gripping element 7 by suitable means, such as a pivotable handle 29 mounted within aperture 31 provided at an end portion of screw 27. Extending through block 19 toward screw 27 is a lubrication passageway 28 having a nipple 30 for attachment of a conventional lubrication tool, such as a grease gun. This lubricating means will insure free rotation of screw 27 and thus smooth advancement and retraction of gripping element 9 attached thereto.

Lifting shackle 5 comprises a plurality of links of chain 32, a lifting ring 33 and a shackle pin 35 for connecting the shackle to clamp body 3 through rotatable coupling 37. Rotatable coupling 37 preferably comprise a rotatable post 39 which protrudes outwardly from clamp body 3 and is rotatably mounted in a bore 41 provided through block 17. Rotatable post 39 is rotatable about its longitudinal axis which extends through a central part of material receiving slot 25 perpendicularly to the advancing direction of screw 27.

Figure 2:
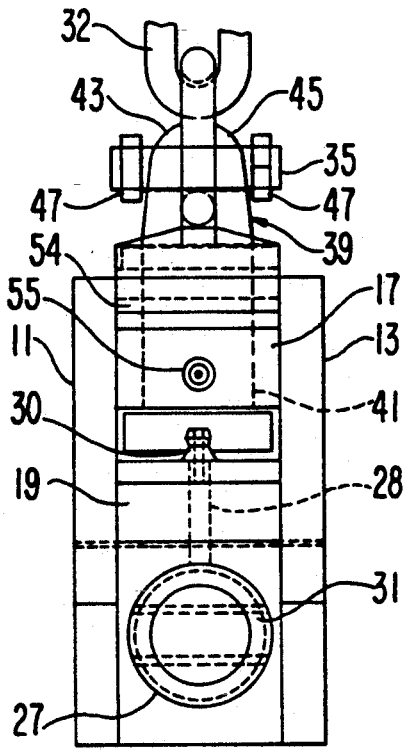
FIG. 2 is an end elevation view of the clamp shown in FIG. 1 illustrating the end of the clamp from which an adjustment screw protrudes.
Figure 3:
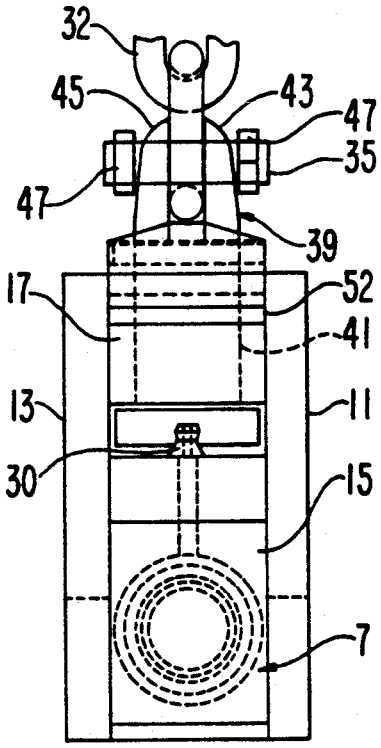
FIG. 3 is an end elevation view of the clamp shown in FIG. 1 illustrating a portion of the clamp on which a pivotable jaw gripping element is mounted.

As seen in the end views of FIGS. 2 and 3, the protruding end portion of rotatable post 39 comprises spaced tapered flanges 43, 45. Shackle pin 35 extends through aligned bores provided in flanges 43, 45 and is held against substantial axial movement by roll pins inserted into transverse bores provided in the ends of pin 35.

Figure 4:
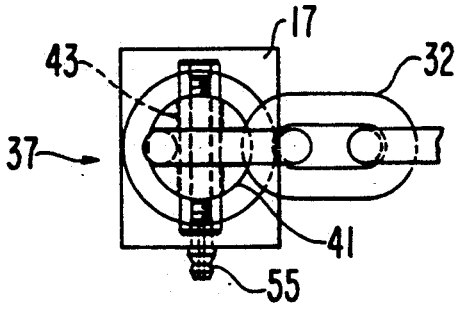
FIG. 4 is a plan view of a rotatable coupling arrangement of the present invention.
Figure 5:
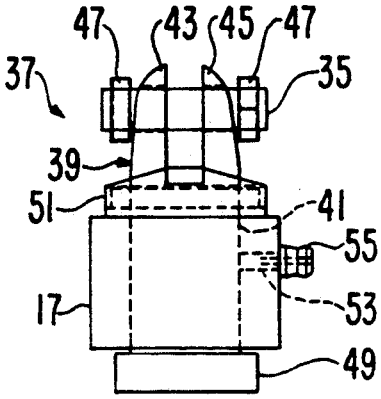
FIG. 5 is a side elevation view of the rotatable coupling arrangement illustrated in FIG. 4.
Figure 6:
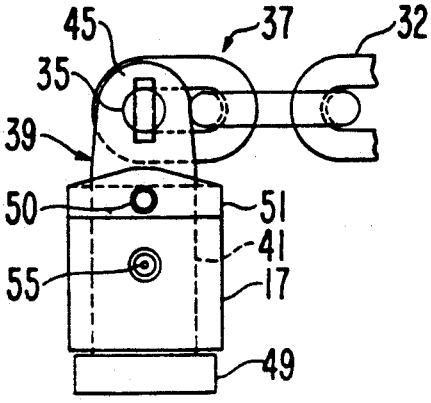
FIG. 6 is a side elevation view of the rotatable coupling, orthogonal to the view of FIG. 5.

Details of rotatable coupling 37 are now described with primary reference to the orthogonal views of FIGS. 4–6, which show the coupling 37 removed from clamp body 3. From FIG. 4, it can be seen that block 17 is substantially rectangular in shape. On the other hand, pin 43 is cylindrical in shape and sized so as to fit with a clearance fit in cylindrical bore 41 provided through block 17. As best seen in FIGS. 5 and 6, rotatable post 39 is secured against substantial axial movement in bore 41 by flanged end portion 49 and a collar member 51 secured to post 39 at a position just below the point at which tapered flanges 43, 45 begin. In the preferred embodiments, flanged end portion 49 is provided as an integral part of post 39, which may be formed by machining or other known forming processes. Collar 51, on the other hand, is removably secured to post 39, once post 39 has been inserted through bore 41 of block 17, by a spiral locking pin 50 or the like. During lifting of a structural member gripped by the clamp, flanged end portion 49 slideably abuts with a first end surface of block 17, and collar member 51 slideably abuts with a second, opposite end surface of block 17.

The upper surface of collar 51 tapers upwardly toward post 39. This taper is desirable to avoid interference during lifting of the collar 51 with the link of chain 32 connected to shackle pin 35. Such interference could occur, e.g., when the angle of the shackle extending direction is less than perpendicular with respect to the rotation axis of post 39. The taper of collar 51 avoids excessive pulling forces being imparted to this last link, as well as damage to the link due to rubbing contact with collar 51.

Two arcuate guard plates 52, 54 span the gap between plates 11, 13 at upper edge portions of clamp body 3, and are preferably welded to plates 11, 13. Plates 52, 54 prevent shackle 5 from getting caught between plates 11, 13 of clamp body 3 during lifting and manipulation of clamp 1.

Rotatable coupling 37 is provided with friction reducing means for reducing the friction between the contacting surfaces of post 39 and block 17. Preferably, the friction reducing means is provided in the form of a lubrication passageway 53 extending through block 17 to the mating outer cylindrical surface of post 39 and the inner surface of bore 41. A nipple 55 is provided for attachment of conventional lubricating equipment such as a grease gun. By providing lubrication between the contacting surfaces of post 39 and block 17, free rotation of post 39 relative to the clamp body 3 is assured, even under the extreme loads and torques encountered during lifting. Other configurations may be employed for applying lubrication between the contacting surfaces of post 39 and block 17. Alternatively, post 39 and block 17 could comprise other friction reducing means as are generally known in the art, e.g., wear resistant low friction bushings or bearings, including replaceable bushings and bearings.

The structure and operation of gripping elements 7 and 9 are now described in detail. In the first preferred embodiment illustrated in FIG. 1, gripping elements 7 and 9 are mounted for limited universal pivotal movement in projecting portion 21 and the end of screw 27, respectively. Such universally pivotal gripping elements are described in detail in commonly assigned U.S. Pat. No. 4,850,630, which is hereby incorporated by reference to the extent necessary for a full understanding of gripping elements 7 and 9.

Each material gripping element 7, 9 comprises a gripping surface *7a, 9a* for contacting opposite surfaces of a structural member. In the illustrated embodiment, gripping surface *7a* is defined by a single sharp circular ridge 57. Alternatively, the gripping surface could be defined by a plurality of concentric circular ridges or, instead of circular gripping teeth, other conventional coplanar gripping surfaces could be employed. Gripping surface *9a* can have a similar circular tooth construction to gripping surface *7a*. Preferably, gripping surface *7a* is made significantly larger in diameter than opposing surface *9a*.

Opposite end of gripping element 7 comprises a section 59 of reduced diameter. Section 59 has a spherical or ball configuration which fits within a socket 61 having a spherical base. Running along the cylindrical perimeter of section 59 is an annular groove 63. In the embodiment shown, a wave spring 65 is inserted into annular groove 63 and extends also into a coextensive annular groove 67 formed in block 15. Suitable wave spring configurations are illustrated and described in previously mentioned U.S. Pat. No. 4,850,630. Alternative arrangements for pivotally securing gripping element 7 in socket 61, such as spiral pins as described in the just-mentioned patent, may be used in place of the illustrated wave spring. However, a wave spring is particularly advantageous in order to keep the gripping element centered in socket 61 when no load is applied, thereby facilitating the initial gripping of a structural member.

The outer end of socket 61 is flared outwardly to define stop means that abut with a correspondingly flared portion of section 59 to restrict pivotal movement of element 7 within a certain range, e.g., 3°–5° in any direction. The inner end portion of gripping element 9, as well as the end of screw 27 in which element 9 is seated, are preferably configured to define a ball and socket coupling similar to gripping element 7 secured within block 15.

By configuring gripping elements 7 and 9 to pivot universally, the following functional advantages are obtained over conventional fixed jaws. First, when a structural member gripped within the clamp swings about during lifting, the gripping surfaces *7a, 9a* are able to move with the structural member and remain substantially parallel to the respective surfaces which they grip, to thereby avoid "walking" of the clamp on the structural member which can result in damage to the structural member and gripping elements and loosening of the clamp.

Additionally, the pivotable mount of the gripping elements 7, 9 allows for development of a camming force of the gripping elements against the member being lifted to improve the grip. More specifically, gripping elements 7 and 9 will tend to cam-in in response to shear forces exerted on the gripping surfaces *7a, 9a* by the structural member which is pulled downwardly by the force of gravity during a lifting operation. This camming action tends to drive a portion of the gripping surfaces *7a, 9a* into the lifted material, i.e., the gripping surface bites into the lifted material to insure a secure grip without the necessity of imparting an extreme compressive force on the structural member via screw 27. By virtue of the universal pivotal action of the gripping elements, the camming-in action can occur for shear forces exerted along gripping surfaces *7a, 9a* through 360°.

Use of the clamp of the present invention is now described. When it is desired to grip a structural member, such as a steel plate, the edge of the plate is introduced into slot 25 and is positioned between gripping elements 7, 9 which are aligned with screw 27. Then, screw 27 is threadedly advanced by means of handle 29, forcing the plate into a gripping relationship between gripping surface *7a* and gripping surface *9a*. Screw 27 need only be firmly tightened manually by virtue of the camming characteristics of one or both of the gripping elements as described above. Once the plate is firmly gripped by the clamp, a lifting operation may be initiated. By virtue of the rotatable coupling 37 which connects shackle 5 to clamp body 3, a variety of lifting operations may be performed. For example, the clamp may be utilized to perform a conventional vertical lift of a plate in a manner such that the lifting force exerted by the rigging is directly above and in line with rotating post 41. This constitutes a conventional vertical lift. Once the plate has been lifted vertically, rotatable coupling 37 allows the lifted plate to be rotated freely through 360° about a vertical axis relative to shackle 5. This avoids entanglement and winding of the lifting rigging.

The clamp may also be used to perform a conventional turn/lift operation wherein the edge of the plate opposite the edge to which the clamp is attached remains in contact with a supporting surface, such as a factory floor, while the plate is turned through a 90° arc to vertical and then back to horizontal through the same 90° arc, or from horizontal to vertical to horizontal through a 180° arc. Such a maneuver is made possible by the ability of rotatable post 39 of coupling 41 to assume the position shown in FIG. 1 wherein shackle pin 35 extends perpendicularly to the general plane of the clamp body to thus define an axis of rotation for shackle 5 through 180° within the general plane of the clamp body. Furthermore, since shackle pin 35 may be rotated 90° so as to create a shackle pivot axis which extends parallel to the general plane defined by clamp body 3, materials can be lifted with up to 90° of side-loading, i.e., a lift can be performed with the shackle 5 extending at up to 90° relative to the general plane of the clamp body.

Figure 7:
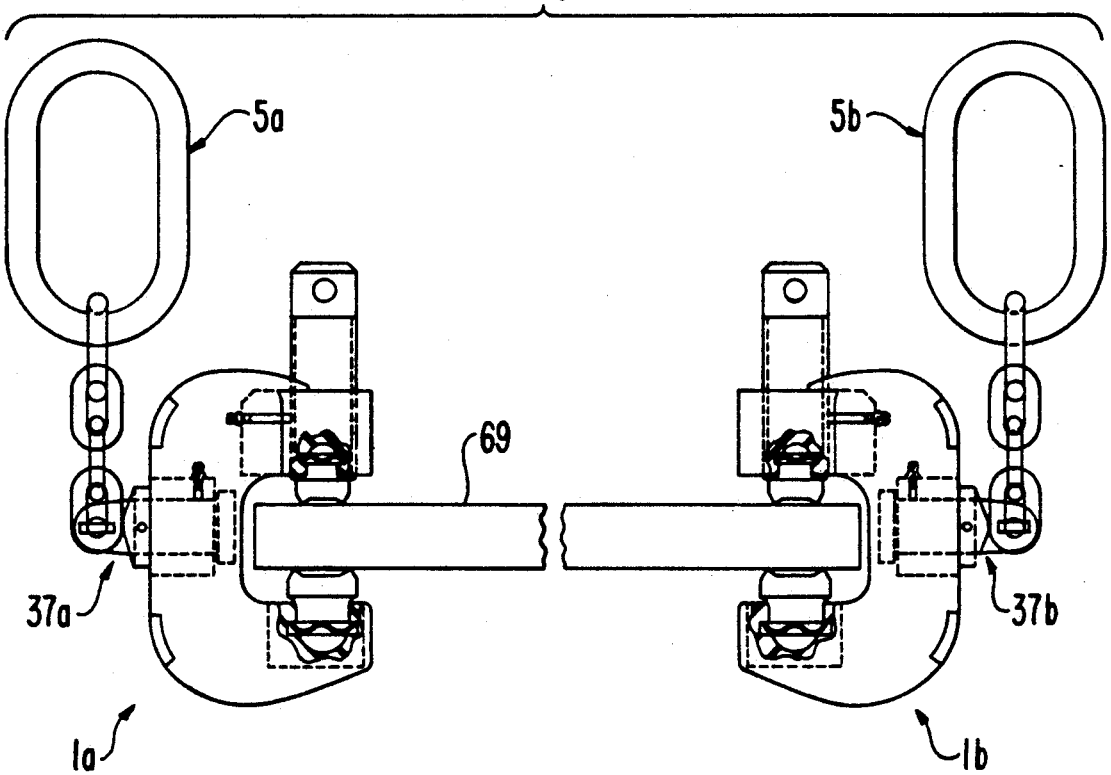
FIG. 7 is a side elevation view of a pair of clamps as shown in FIG. 1 gripping and suspending horizontally a structural member.
Figure 8:
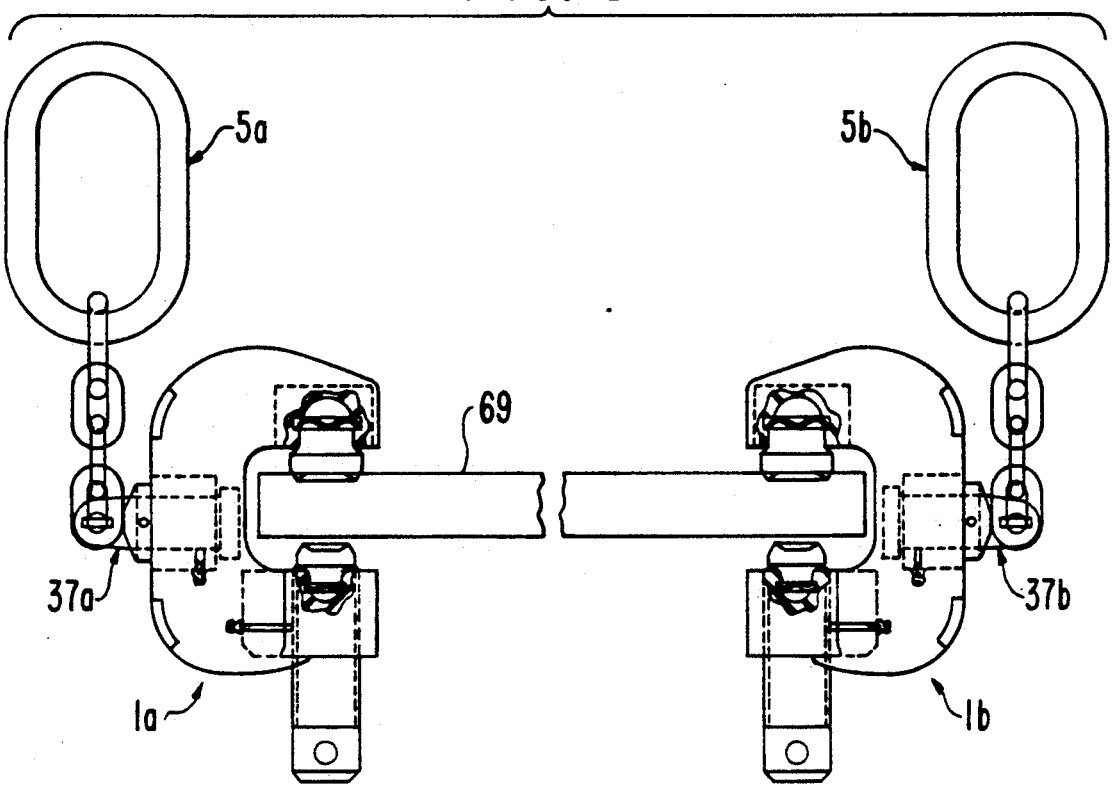
FIG. 8 is a view similar to FIG. 7, with the clamps and structural member rotated 180° to an inverted position.

A pair of clamps in accordance with the present invention are usable to perform a material lifting and manipulating process not possible with previous clamp designs. As shown in FIGS. 7 and 8, a pair of clamps 1*a*, 1*b* are secured to opposite edge portions of a plate 69 in substantial alignment with a chosen axis about which it is desired to rotate the plate. Upon so securing clamps 1*a*, 1*b* on plate 69, plate 69 is lifted via the lifting shackles 5*a*, 5*b* attached respectively to a lifting device. Such a lifting operation can be performed with shackles 5a, 5b extending generally perpendicular to the longitudinal axes of rotatable couplings 37a, 37b as shown. Alternatively, lifting can be performed at other angles at which the shackle 5 does not interfere with the clamp body 3, adjusting screw 27 or adjusting screw handle 29. For example, it is conventional to utilize a multilegged sling to attach multiple clamps to a single lifting line, wherein the shackles 5 and cables or chains attached thereto converge toward the single line at an angle such as 60°.

Once the plate 69 is suspended by respective shackles 5a, 5b with the rotation axis of the structural member extending generally horizontally, it is then possible to rotate plate 69 about the axes of rotation of rotatable couplings 37a, 37b which substantially coincide with each other and the chosen rotation axis of plate 69. For certain applications, it may be desirable to choose a rotation axis of the structural member upon which a center of gravity of the structural member lies, so that plate 69 is balanced to rest at any given angular orientation. Other applications may dictate that an off-center rotation axis be chosen such that there will exist among the possible angular orientations of the structural member a single equilibrium position.

As illustrated in FIG. 8, plate 69 and attached clamps 1a, 1b may be rotated through 180° to an inverted position. This advantageously facilitates fabrication operations to be performed on opposite surfaces of a structural member. The plate 69 may then be returned to its original position through the same 180° arc, or by completing a 360° rotation.

Various other lifting operations and manipulations possible with the present clamp will occur to those of ordinary skill in the art.

Figure 9:
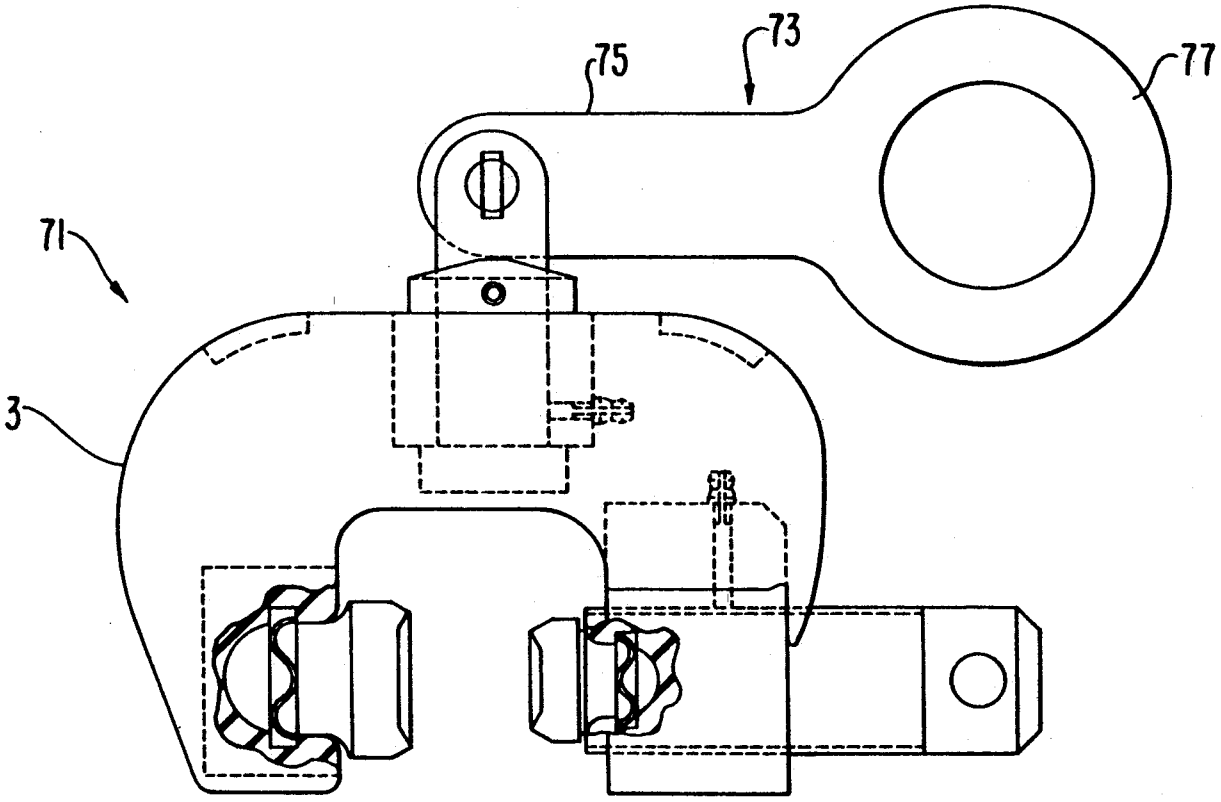
FIG. 9 is a partially broken-away side elevation view illustrating a second embodiment of the present invention incorporating an alternative shackle arrangement.

Alternative embodiments of clamps in accordance with the present invention are now described in connection with FIGS. 9 and 10. Referring first to FIG. 9, 71 designates a clamp having a modified lifting shackle 73 comprising an integrally formed extension member 75 and lifting ring 77. Otherwise, clamp 71 of FIG. 9 is identical to clamp 1 shown in FIG. 1.

Figure 10:
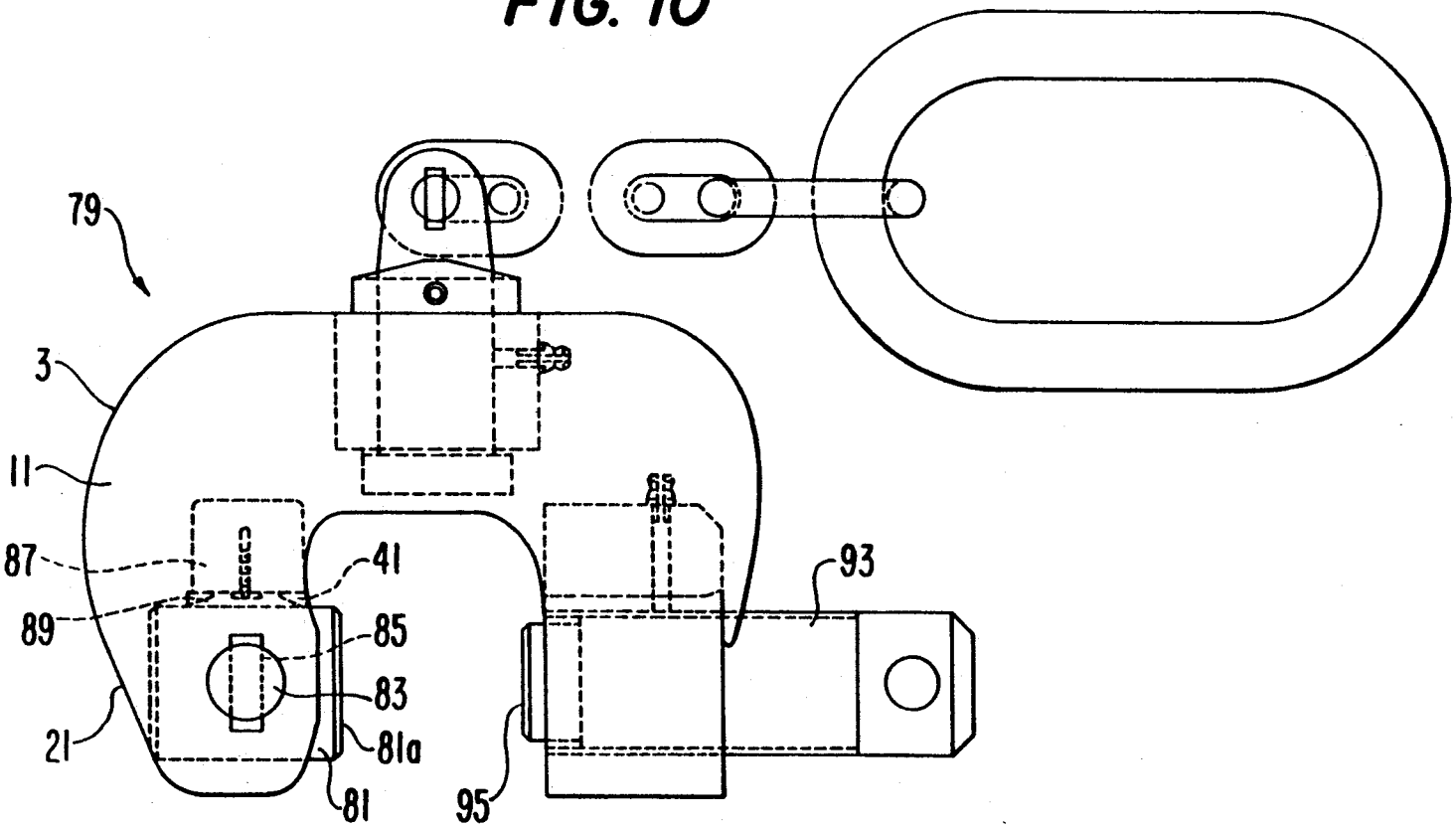
FIG. 10 is a side elevation view of a third embodiment of the present invention having an alternative arrangement of material gripping elements.

Referring now to FIG. 10, shown is a clamp 79 which is substantially identical in structure to clamp 1 shown in FIG. 1 but for the configuration of material gripping elements 81 and 95. Elements of clamp 79 which correspond in structure to elements appearing in clamp 1 of FIG. 1 are denoted by like reference numerals. Gripping element 81 is pivotally attached to first projecting portion 21 of clamp body 3 by means of a pivot pin 83 extending between and pivotally secured within bores provided in plates 11, 13 (only plate 11 is visible in FIG. 10). Axial movement of pin 83 relative to plates 11, 13 is restricted by roll pins 85 inserted in bore provided in opposite end portions of pivot pin 83 (only one roll pin 85 visible in FIG. 10). A block 87 is weldably attached to plates 11, 13 above element 81. Secured to block 87 is a leaf spring 89 serving to bias the gripping member 81 into a position with its gripping surface 81a extending substantially vertically. Pivotal movement of element 81 is restricted by lower surface 91 of block 87 which will abut the outer cylindrical surface of gripping element 81 at a predetermined angular displacement of element 81 from the position shown in FIG. 10. Screw 93 is similar to screw 27 in clamp 1 shown in FIG. 1, except that a non-pivotal gripping element 95 is provided at the end thereof.

The configuration of gripping elements 81 and 95 in the embodiment of FIG. 10 corresponds substantially to the configuration shown and described in commonly owned U.S. Pat. No. 4,183,571. This patent is hereby incorporated by reference to the extent necessary for a full understanding of gripping elements 81 and 95. With this configuration, shear forces exerted on the face of gripping element 81 which create a moment about pivot pin 83 will urge element 81 to cam-in to enhance the grip provided by the clamp, similar to the first embodiment.

As shown, gripping elements 81, 95 incorporate a gripping surface consisting of a single sharp circular ridge as described in connection with clamp 1 of FIG. 1. Clamp 81 may, if desired, incorporate the convex-shaped gripping surface described in U.S. Pat. No. 4,183,571, for the advantages described therein.

Clamp 79 may be used in substantially the same manner as clamp 1. However, since gripping element 81 has a single pivot axis, bidirectional rather than omnidirectional pivoting and camming-in action is obtained.

The invention has been described in terms of preferred embodiments thereof. Other embodiments and modifications within the scope and spirit of the present invention will occur to those having ordinary skill in the art, upon reading this disclosure. Thus, the present invention is limited solely by the appended claims.

I claim:

1. A clamp for gripping and lifting materials, comprising:

a clamp body having spaced, opposed, first and second body portions fixed relative to each other and defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp; and coupling means attached to said clamp body for coupling said clamp to a lifting device, said coupling means comprising (a) a coupling member protruding from said clamp body and being coupled with said clamp body so as to be rotatable 360° relative to the clamp body about an axis which, during lifting of a structural member gripped by the clamp, extends through the material receiving slot substantially perpendicularly to an advancing direction of said adjusting means, said coupling member having connector means for attachment to a lifting device, and (b) friction reducing means for reducing friction between said coupling member and said clamp body so as to ensure free 360° rotatability of the clamp body relative to the coupling member during lifting of a structural member gripped by the clamp, wherein said coupling member comprises a post which is rotatable about its longitudinal axis and extends outwardly from the clamp body, and said connecting means comprises a shackle arrangement provided at an end portion of said post, said shackle arrangement comprising a shackle pin extending between spaced flanges provided at the end portion of said post, at least one link of chain pivotally attached to said shackle pin, and a lifting ring attached to said at least one link of chain.

2. A clamp according to claim 1, wherein said friction reducing means comprises a passageway extending through a portion of said clamp body for supplying lubricant to contacting surfaces of said coupling member and clamp body.

3. A clamp according to claim 1, wherein said clamp body comprises a block fixedly secured between two generally U-shaped plates, said block having a bore provided therein, and said coupling member comprises a rotatable post protruding from the clamp body, freely rotable in said bore, and restrained against substantial axial movement therein.

4. A clamp according to claim 1, further comprising a gripping element pivotally mounted to one of said first and second body portions, said gripping element having an outer end defining one of said first and second material gripping surfaces, whereby upon lifting a structural member gripped between the gripping surfaces, a portion of the gripping surface of the gripping element is urged inwardly in a camming manner toward a surface of the structural member, to thereby securely grip the structural member.

5. A clamp according to claim 4, wherein said gripping element is pivotally mounted to pivot about a fixed pivot axis extending perpendicularly to a general plane defined by the clamp body.

6. A clamp according to claim 4, wherein an inner end of the gripping element and the one of said body portions in which it is mounted define a close fitting ball and socket connection therebetween to permit a universal pivotal movement of said gripping element.

7. A clamp according to claim 4, wherein a said gripping element is pivotally mounted to each of said first and second body portions.

8. A clamp according to claim 1, wherein said adjusting means comprises a screw having a shaft threadedly received through said first body portion, said screw having a first end defining said first material gripping surface and extending into said slot toward said second body portion, said screw being threadedly movable toward and away from said second body portion.

9. A clamp for gripping and lifting materials, comprising:

a clamp body having spaced, opposed, first and second body portions defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp;

a gripping element pivotally mounted to one of said first and second body portions, said gripping element having an outer end defining one of said first and second material gripping surfaces, whereby upon lifting a structural member gripped between the gripping surfaces, a portion of the gripping surface of the gripping element is urged inwardly in a camming manner toward a surface of the structural member, to thereby securely grip the structural member; and coupling means attached to said clamp body for coupling said clamp to a lifting device, said coupling means comprising (a) a coupling member protruding from said clamp body and being rotatably coupled thereto so as to be rotatable about an axis which, during lifting of a structural member gripped by the clamp, extends through the material receiving slot substantially perpendicularly to an advancing direction of said adjusting means, and (b) connecting means for attachment to a lifting device;

wherein:

said clamp body comprises a block fixedly secured between two generally U-shaped plates, said block having a bore provided therein, and said coupling member comprises a rotatable post protruding from the clamp body, freely rotatable in said bore, and restrained against substantial axial movement therein; and the connecting means comprises a shackle arrangement at an end portion of said rotatable post, and said rotatable post comprises a collar member which slidably abuts with an end surface of said block, said collar member having a tapered upper surface for avoiding interference with the shackle arrangement during lifting of a structural member gripped by the clamp.

10. A clamp according to claim 9, wherein said shackle arrangement comprises a shackle pin extending between spaced flanges provided at an end portion of said post, at least one link of chain pivotally attached to said shackle pin, and a lifting ring attached to said at least one link of chain.

11. A clamp according to claim 9, wherein said shackle arrangement comprises a shackle pin extending between spaced flanges provided at an end portion of said post, and an integrally formed combination lifting eye and elongated extension member pivotally attached thereto.

12. A clamp according to claim 9, wherein said gripping element is pivotally mounted to pivot about a fixed pivot axis extending perpendicularly to a general plane defined by the clamp body.

13. A clamp according to claim 9, wherein an inner end of the gripping element and the one of said body portions in which it is mounted define a close fitting ball and socket connection therebetween to permit a universal pivotal movement of said gripping element.

14. A clamp according to claim 9, wherein a said gripping element is pivotally mounted to each of said first and second body portions.

15. A clamp according to claim 9, wherein said adjusting means comprises a screw having a shaft threadedly received through said first body portion, said screw having a first end defining said first material gripping surface and extending into said slot toward said second body portion, said screw being threadedly movable toward and away from said second body portion.

16. A clamp according to claim 9, wherein said coupling means further includes friction reducing means for reducing friction between said coupling member and said clamp body so as to ensure free 360° rotation of the clamp body relative to the coupling member during lifting of a structural member gripped by the clamp.

17. A clamp according to claim 16, wherein said friction reducing means comprises a passageway extending through a portion of said clamp body for supplying lubricant to contacting surfaces of said coupling member and clamp body.

18. A screw-type clamp for gripping and lifting materials, comprising:

a generally U-shaped clamp body having first and second projecting portions defining therebetween a material receiving slot;

a screw having a shaft threadedly received through said first body projection for rotation about a first axis extending in a general plane defined by the clamp body, said screw having a first end defining a first material gripping surface and extending into said slot toward said second body projection, said screw being threadedly movable toward and away from said second body projection;

a gripping element having an inner end mounted in said second body projection and an outer end defining a second material gripping surface so that threaded movement of the screw toward said gripping element urges a structural member in said slot into a gripping relationship between the first and second material gripping surfaces to enable the structural member to be lifted by the clamp, said second body projection and said inner end of said gripping element defining a ball and socket connection therebetween to permit a universal pivotable rotation of the outer end of said gripping element during lifting of the structural member, whereby a portion of the second gripping element is urged inwardly in a camming manner toward a surface of the structural member, to thereby securely grip the structural member; and a coupling member comprising (a) a rotatable post protruding from the clamp body and being rotatably mounted thereto so as to be freely rotatable through 360° about an axis which, during lifting of a structural member gripped by the clamp, extends through the material receiving slot substantially perpendicularly to an advancing direction of said screw, and (b) a shackle arrangement provided at an end portion of said post;

wherein:

said clamp body is formed by two substantially identical plate members weldably connected to each other through a plurality of blocks;

said rotatable post is rotatably secured in a bore provided in one of said plurality of blocks; and said rotatable post comprises a flanged end portion which slidably abuts with a first end surface of said one block, and a collar member which slidably abuts with a second end surface of said one block, said collar member having a tapered upper surface for avoiding interference with said shackle arrangement during lifting of a structural member gripped by the clamp.

19. A screw-type clamp according to claim 18, wherein said one block in which the rotatable post is secured further comprises a passageway for supplying lubricant to contacting surfaces of said rotatable post and one block.

20. A method for lifting and rotatably manipulating a structural member, comprising the steps of:

determining a rotation axis of the structural member about which it is desired to rotate the structural member;

securing to opposite edge portions of the structural member, in substantial alignment with said rotation axis, first and second independent clamping means, each clamping means having a material receiving slot, first and second material gripping surfaces, adjusting means for adjusting the distance between the first and second gripping surfaces, and a rotatable coupling member which has an axis of rotation extending through and substantially aligned with said material receiving slot; said securing being performed by positioning each clamp such that a respective said edge portion of the structural member extends into the material receiving slot, and causing each clamping means to grip the structural member by reducing with said adjusting means the distance between said first and second gripping surfaces;

lifting said structural member via respective shackle arrangements connected to said coupling member of each clamping means such that said structural member is suspended by said shackle arrangements with the rotation axis of the structural member extending in a generally horizontal direction; and rotating said structural member about the axes of rotation of the connecting members of the respective clamping means, said axes of rotation substantially coinciding with each other and the rotation axis of the structural member.

21. A method according to claim 20, wherein said determining step comprises choosing as said rotation axis of the structural member a central axis on which the center of gravity of the structural member lies.

22. A method according to claim 20, wherein said rotating step comprises rotating said structural member through 360°.

23. A clamp for gripping and lifting materials, comprising:

a clamp body having spaced, opposed, first and second body portions defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp; and coupling means attached to said clamp body for coupling said clamp to a lifting device, said coupling means comprising (a) a coupling member coupled with said clamp body so as to be rotatable 360° relative to the clamp body, said coupling member having connector means for attachment to a lifting device, and (b) friction reducing means for reducing friction between said coupling member and said clamp body so as to ensure free 360° rotatability of the clamp body relative to the coupling member during lifting of a structural member gripped by the clamp, said friction reducing means comprising a passageway extending through a portion of said clamp body for supplying lubricant to contacting surfaces of said coupling member and clamp body.

24. A clamp for gripping and lifting materials, comprising:

a clamp body having spaced, opposed, first and second body portions defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp; and coupling means attached to said clamp body for coupling said clamp to a lifting device, said coupling means comprising (a) a coupling member coupled with said clamp body so as to be rotatable 360° relative to the clamp body, said coupling member having connector means for attachment to a lifting device, and (b) friction reducing means for reducing friction between said coupling member and said clamp body so as to ensure free 360° rotatability of the clamp body relative to the coupling member during lifting of a structural member gripped by the clamp;

wherein said coupling member comprises a post which is rotatable about its longitudinal axis and extends outwardly from the clamp body, and said connecting means comprises a shackle arrangement provided at an end portion of said post, said shackle arrangement comprising a shackle pin extending between spaced flanges provided at the end portion of said post, at least one link of chain pivotally attached to said shackle pin, and a lifting ring attached to said at least one link of chain.

25. A clamp for gripping and lifting materials, comprising:

a clamp body having spaced, opposed, first and second body portions defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp; and coupling means attached to said clamp body for coupling said clamp to a lifting device, said coupling means comprising (a) a coupling member coupled with said clamp body so as to be rotatable 360° relative to the clamp body, said coupling member having connector means for attachment to a lifting device, and (b) friction reducing means for reducing friction between said coupling member and said clamp body so as to ensure free 360° rotatability of the clamp body relative to the coupling member during lifting of a structural member gripped by the clamp;

wherein said coupling member comprises a post which is rotatable about its longitudinal axis and extends outwardly from the clamp body, and said connecting means comprises a shackle arrangement provided at an end portion of said post, said shackle arrangement comprising a shackle pin extending between spaced flanges provided at an end portion of said post, and an integrally formed combination lifting eye and elongated extension member pivotally attached thereto.

26. A clamp for gripping and lifting materials, comprising:

a clamp body having spaced, opposed, first and second body portions defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp; and coupling means attached to said clamp body for coupling said clamp to a lifting device, said coupling means comprising (a) a coupling member protruding from said clamp body and being rotatably coupled thereto so as to be rotatable about an axis which extends through the material receiving slot substantially perpendicularly to an advancing direction of said adjusting means, and (b) connecting means for attachment to a lifting device;

wherein said coupling member comprises a post which is rotatable about its longitudinal axis and extends outwardly from the clamp body, and said connecting means comprises a shackle arrangement provided at an end portion of said post, said shackle arrangement comprising a shackle pin extending between spaced flanges provided at an end portion of said post, at least one link of chain pivotally attached to said shackle pin, and a lifting ring attached to said at least one link of chain.

27. A clamp for gripping and lifting materials, comprising:

a clamp body having spaced, opposed, first and second body portions defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp; and coupling means attached to said clamp body for coupling said clamp to a lifting device, said coupling means comprising (a) a coupling member protruding from said clamp body and being rotatably coupled thereto so as to be rotatable about an axis which extends through the material receiving slot substantially perpendicularly to an advancing direction of said adjusting means, and (b) connecting means for attachment to a lifting device;

wherein said coupling member comprises a post which is rotatable about its longitudinal axis and extends outwardly from the clamp body, and said connecting means comprises a shackle arrangement provided at an end portion of said post, said shackle arrangement comprising a shackle pin extending between spaced flanges provided at an end portion of said post, and an integrally formed combination lifting eye and elongated extension member pivotally attached thereto.

28. A clamp for gripping and lifting materials, comprising:

a clamp body having spaced, opposed, first and second body portions defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp; and coupling means attached to said clamp body for coupling said clamp to a lifting device, said coupling means comprising (a) a coupling member protruding from said clamp body and being rotatably coupled thereto so as to be rotatable about an axis which extends through the material receiving slot substantially perpendicularly to an advancing direction of said adjusting means, and (b) connecting means for attachment to a lifting device;

wherein:

said clamp body comprises a block fixedly secured between two generally U-shaped plates, said block having a bore provided therein, and said coupling member comprises a rotatable post protruding from the clamp body, freely rotatable in said bore, and restrained against substantial axial movement therein;

said rotatable post comprises a flanged end portion which slideably abuts with a first end surface of said block, and a collar member which slideably abuts with a second end surface of said block; and said collar member has a tapered upper surface for avoiding interference with said connecting means during lifting of a structural member gripped by the clamp.

29. A clamp for gripping and lifting materials, comprising:

a clamp body having spaced, opposed, first and second body portions defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp; and coupling means attached to said clamp body for coupling said clamp to a lifting device, said coupling means comprising (a) a coupling member protruding from said clamp body and being rotatably coupled thereto so as to be rotatable about an axis which extends through the material receiving slot substantially perpendicularly to an advancing direction of said adjusting means, and (b) connecting means for attachment to a lifting device;

wherein:

said clamp body comprises a block fixedly secured between two generally U-shaped plates, said block having a bore provided therein, and said coupling member comprises a rotatable post protruding from the clamp body, freely rotatable in said bore, and restrained against substantial axial movement therein; and said connecting means comprises a shackle arrangement provided at an end portion of said rotatable post, and said rotatable post comprises a collar member which slideably abuts with an end surface of said block, said collar member having a tapered upper surface for avoiding interference with the shackle arrangement during lifting of a structural member gripped by the clamp.

30. A clamp for gripping and lifting materials, comprising:

a clamp body having spaced, opposed, first and second body portions defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp; and coupling means attached to said clamp body for coupling said clamp to a lifting device, said coupling means comprising (a) a coupling member protruding from said clamp body and being rotatably coupled thereto so as to be rotatable about an axis which extends through the material receiving slot substantially perpendicularly to an advancing direction of said adjusting means, and (b) connecting means for attachment to a lifting device;

wherein said coupling means further includes friction reducing means for reducing friction between said coupling member and said clamp body so as to ensure free 360° rotation of the clamp body relative to the coupling member during lifting of a structural member gripped by the clamp, said friction reducing means comprising a passageway extending through a portion of said clamp body for supplying lubricant to contacting surfaces of said coupling member and clamp body.

31. A screw-type clamp for gripping and lifting materials, comprising:

a generally U-shaped clamp body having first and second projecting portions defining therebetween a material receiving slot;

a screw having a shaft threadedly received through said first body projection for rotation about a first axis extending in a general plane defined by the clamp body, said screw having a first end defining a first material gripping surface and extending into said slot toward said second body projection, said screw being threadedly movable toward and away from said second body projection;

a gripping element having an inner end mounted in said second body projection and an outer end defining a second material gripping surface so that threaded movement of the screw toward said gripping element urges a structural member in said slot into a gripping relationship between the first and second material gripping surfaces to enable the structural member to be lifted by the clamp, said second body projection and said inner end of said gripping element defining a ball and socket connection therebetween to permit a universal pivotable rotation of the outer end of said gripping element during lifting of the structural member, whereby a portion of the second gripping element is urged inwardly in a camming manner toward a surface of the structural member, to thereby securely grip the structural member; and a coupling member comprising (a) a rotatable post protruding from the clamp body and being rotatably mounted thereto so as to be freely rotatable through 360° about an axis which extends through the material receiving slot substantially perpendicularly to an advancing direction of said screw, and (b) a shackle arrangement provided at an end portion of said post;

wherein:

said clamp body is formed by two substantially identical plate members weldably connected to each other through a plurality of blocks;

said rotatable post is rotatably secured in a bore provided in one of said plurality of blocks; and said one block in which the rotatable post is secured further comprises a passageway for supplying lubricant to contacting surfaces of said rotatable post and one block.

32. A screw-type clamp for gripping and lifting materials, comprising:

a generally U-shaped clamp body having first and second projecting portions defining therebetween a material receiving slot;

a screw having a shaft threadedly received through said first body projection for rotation about a first axis extending in a general plane defined by the clamp body, said screw having a first end defining a first material gripping surface and extending into said slot toward said second body projection, said screw being threadedly movable toward and away from said second body projection;

a gripping element having an inner end mounted in said second body projection and an outer end defining a second material gripping surface so that threaded movement of the screw toward said gripping element urges a structural member in said slot into a gripping relationship between the first and second material gripping surfaces to enable the structural member to be lifted by the clamp, said second body projection and said inner end of said gripping element defining a ball and socket connection therebetween to permit a universal pivotable rotation of the outer end of said gripping element during lifting of the structural member, whereby a portion of the second gripping element is urged inwardly in a camming manner toward a surface of the structural member, to thereby securely grip the structural member; and a coupling member comprising (a) a rotatable post protruding from the clamp body and being rotatably mounted thereto so as to be freely rotatable through 360° about an axis which extends through the material receiving slot substantially perpendicularly to an advancing direction of said screw, and (b) a shackle arrangement provided at an end portion of said post;

wherein:

said clamp body is formed by two substantially identical plate members weldably connected to each other through a plurality of blocks;

said rotatable post is rotatably secured in a bore provided in one of said plurality of blocks; and said rotatable post comprises a flanged end portion which slideably abuts with a first end surface of said one block, and a collar member which slideably abuts with a second end surface of said one block, said collar member having a tapered upper surface for avoiding interference with said shackle arrangement during lifting of a structural member gripped by the clamp.

33. A clamp for gripping and lifting materials, comprising:

a clamp body having spaced, opposed, first and second body portions fixed relative to each other and defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp; and coupling means attached to said clamp body for coupling said clamp to a lifting device, said coupling means comprising (a) a coupling member protruding from said clamp body and being coupled with said clamp body so as to be rotatable 360° relative to the clamp body about an axis which, during lifting of a structural member gripped by the clamp, extends through the material receiving slot substantially perpendicularly to an advancing direction of said adjusting means, said coupling member having connector means for attachment to a lifting device, and (b) friction reducing means for reducing friction between said coupling member and said clamp body so as to ensure free 360° rotatability of the clamp body relative to the coupling member during lifting of a structural member gripped by the clamp, said friction reducing means comprising a passageway extending through a portion of said clamp body for supplying lubricant to contacting surfaces of said coupling member and clamp body.

34. A clamp for gripping and lifting materials, comprising:

a clamp body having spaced, opposed, first and second body portions fixed relative to each other and defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp; and coupling means attached to said clamp body for coupling said clamp to a lifting device, said coupling means comprising (a) a coupling member protruding from said clamp body and being coupled with said clamp body so as to be rotatable 360° relative to the clamp body about an axis which, during lifting of a structural member griped by the clamp, extends through the material receiving slot substantially perpendicularly to an advancing direction of said adjusting means, said coupling member having connector means for attachment to a lifting device, and (b) friction reducing means for reducing friction between said coupling member and said clamp body so as to ensure free 360° rotatability of the clamp body relative to the coupling member during lifting of a structural member gripped by the clamp;

wherein said coupling member comprises a post which is rotatable about its longitudinal axis and extends outwardly from the clamp body, and said connecting means comprises a shackle arrangement provided at an end portion of said post, said shackle arrangement comprising a shackle pin extending between spaced flanges provided at an end portion of said post, and an integrally formed combination lifting eye and elongated extension member pivotally attached thereto.

35. A clamp for gripping and lifting materials, comprising:

a clamp body having spaced, opposed, first and second body portions defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp;

a gripping element pivotally mounted to one of said first and second body portions, said gripping element having an outer end defining one of said first and second material gripping surfaces, whereby upon lifting a structural member gripped between the gripping surfaces, a portion of the gripping surface of the gripping element is urged inwardly in a camming manner toward a surface of the structural member, to thereby securely grip the structural member; and coupling means attached to said clamp body for coupling said clamp to a lifting device, said coupling means comprising (a) a coupling member protruding from said clamp body and being rotatably coupled thereto so as to be rotatable about an axis which, during lifting of a structural member gripped by the clamp, extends through the material receiving slot substantially perpendicularly to an advancing direction of said adjusting means, and (b) connecting means for attachment to a lifting device;

wherein said coupling member comprises a post which is rotatable about its longitudinal axis and extends outwardly from the clamp body, and said connecting means comprises a shackle arrangement provided at an end portion of said post, said shackle arrangement comprising a shackle pin extending between spaced flanges provided at an end portion of said post, and an integrally formed combination lifting eye and elongated extension member pivotally attached thereto.

36. A clamp for gripping and lifting materials, comprising:

a clamp body having spaced, opposed, first and second body portions defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp;

a gripping element pivotally mounted to one of said first and second body portions, said gripping element having an outer end defining one of said first and second material gripping surfaces, whereby upon lifting a structural member gripped between the gripping surfaces, a portion of the gripping surface of the gripping element is urged inwardly in a camming manner toward a surface of the structural member, to thereby securely grip the structural member; and coupling means attached to said clamp body for coupling said clamp to a lifting device, said coupling means comprising (a) a coupling member protruding from said clamp body and being rotatably coupled thereto so as to be rotatable about an axis which, during lifting of a structural member gripped by the clamp, extends through the material receiving slot substantially perpendicularly to an advancing direction of said adjusting means, and (b) connecting means for attachment to a lifting device;

wherein:

said clamp body comprises a block fixedly secured between two generally U-shaped plates, said block having a bore provided therein, and said coupling member comprising a rotatable post protruding from the clamp body, freely rotatable in said bore, and restrained against substantial axial movement therein;

said rotatable post comprises a flanged end portion which slidably abuts with a first end surface of said block, and a collar member which slidably abuts with a second end surface of said block; and said collar member has a tapered upper surface for avoiding interference with said connecting means during lifting of a structural member gripped by the clamp.

37. A clamp for gripping and lifting materials, comprising:

a clamp body having spaced, opposed, first and second body portions defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp;

a gripping element pivotally mounted to one of said first and second body portions, said gripping element having an outer end defining one of said first and second material gripping surfaces, whereby upon lifting a structural member gripped between the gripping surfaces, a portion of the gripping surface of the gripping element is urged inwardly in a camming manner toward a surface of the structural member, to thereby securely grip the structural member; and coupling means attached to said clamp body for coupling said clamp to a lifting device, said coupling means comprising (a) a coupling member protruding from said clamp body and being rotatably coupled thereto so as to be rotatable about an axis which, during lifting of a structural member gripped by the clamp, extends through the material receiving slot substantially perpendicularly to an advancing direction of said adjusting means, and (b) connecting means for attachment to a lifting device;

wherein said coupling member comprises a post which is rotatable about its longitudinal axis and extends outwardly from the clamp body, and said connecting means comprises a shackle arrangement provided at an end portion of said post, said shackle arrangement comprising a shackle pin extending between spaced flanges provided at an end portion of said post, at least one link of chain pivotally attached to said shackle pin, and a lifting ring attached to said at least one link of chain.

38. A clamp for gripping and lifting materials, comprising:

a clamp body having spaced, opposed, first and second body portions defining therebetween a material receiving slot, said first and second body portions having attached thereto first and second material gripping surfaces, respectively;

adjusting means for adjusting the distance between said first and second material gripping surfaces such that a structural member positioned within said material receiving slot is gripped between said gripping surfaces when the distance between the gripping surfaces is reduced, to thereby enable a structural member to be lifted by the clamp;

a gripping element pivotally mounted to one of said first and second body portions, said gripping element having an outer end defining one of said first and second material gripping surfaces, whereby upon lifting a structural member gripped between the gripping surfaces, a portion of the gripping surface of the gripping element is urged inwardly in a camming manner toward a surface of the structural member, to thereby securely grip the structural member; and coupling means attached to said clamp body for coupling said clamp to a lifting device, said coupling means comprising (a) a coupling member protruding from said clamp body and being rotatably coupled thereto so as to be rotatable about an axis which, during lifting of a structural member gripped by the clamp, extends through the material receiving slot substantially perpendicularly to an advancing direction of said adjusting means, and (b) connecting means for attachment to a lifting device;

wherein said coupling means further includes friction reducing means for reducing friction between said coupling member and said clamp body so as to ensure free 360° rotation of the clamp body relative to the coupling member during lifting of a structural member gripped by the clamp, said friction reducing means comprising a passageway extending through a portion of said clamp body for supply lubricant contacting surfaces of said coupling member and clamp body.

39. A screw-type clamp for gripping and lifting materials, comprising:

a generally U-shaped clamp body having first and second projecting portions defining therebetween a material receiving slot;

a screw having a shaft threadedly received through said first body projection for rotation about a first axis extending in a general plane defined by the clamp body, said screw having a first end defining a first material gripping surface and extending into said slot toward said second body projection, said screw being threadedly movable toward and away from said second body projection;

a gripping element having an inner end mounted in said second body projection and an outer end defining a second material gripping surface so that threaded movement of the screw toward said gripping element urges a structural member in said slot into a gripping relationship between the first and second material gripping surfaces to enable the structural member to be lifted by the clamp, said second body projection and said inner end of said gripping element defining a ball and socket connection therebetween to permit a universal rotation of the outer end of said gripping element during lifting of the structural member, whereby a portion of the second gripping element is urged inwardly in a camming manner toward a surface of the structural member, to thereby securely grip the structural member; and a coupling member comprising (a) a rotatable post protruding from the clamp body and being rotatably mounted thereto so as to be freely rotatable through 360° about an axis which, during lifting of a structural member gripped by the clamp, extends through the material receiving slot substantially perpendicularly to an advancing direction of said screw, and (b) a shackle arrangement provided at an end portion of said post;

wherein:

said clamp body is formed by two substantially identical plate members weldably connected to each other through a plurality of blocks;

said rotatable post is rotatably secured in a bore provided in one of said plurality of blocks; and said one block in which the rotatable post is secured further comprises a passageway for supplying lubricant to contacting surfaces of said rotatable post and one block.

* * * * *